US005203324A

United States Patent [19]

Kinkade

[11] Patent Number: 5,203,324

[45] **Date of Patent: * Apr. 20, 1993**

[54] CONTOURED ANATOMICAL MOUTHPIECE

[75] Inventor: Donald J. Kinkade, Greeley, Colo.

[73] Assignee: Kinkade Family Partnership, Greeley, Colo.

[ * ] Notice: The portion of the term of this patent subsequent to Nov. 5, 2008 has been disclaimed.

[21] Appl. No.: 679,517

[22] Filed: Apr. 2, 1991

Related U.S. Application Data

[63] Continuation-in-part of Ser. No. 449,560, Dec. 12, 1989, Pat. No. 5,062,422, which is a continuation-in-part of Ser. No. 283,611, Dec. 13, 1988, abandoned.

[51] Int. Cl.[5] ..... B63C 11/16; A61M 16/00; A62B 9/06; A61C 5/14

[52] U.S. Cl. ..... 128/201.11; 128/207.14; 128/861; 128/862

[58] Field of Search ..... 128/201.11, 861, 862, 128/207.14, 857, 859, 200.24, 200.26, 201.26, 201.27, 206.29, DIG. 26, 911, 912; 433/6, 215, 229

[56] References Cited

U.S. PATENT DOCUMENTS

| | | | |
|---|---|---|---|
| 2,750,941 | 6/1956 | Cathcart | 128/826 |
| 3,485,242 | 12/1969 | Greenberg | 128/862 |
| 5,062,422 | 11/1991 | Kinkade | 128/201.11 |

FOREIGN PATENT DOCUMENTS

| | | | |
|---|---|---|---|
| 422834 | 6/1947 | Italy | 128/207.14 |

*Primary Examiner*—Edgar S. Burr
*Assistant Examiner*—Kimberly L. Asher
*Attorney, Agent, or Firm*—David S. Woronoff

[57] ABSTRACT

A mouthpiece for use in diving or medical equipment, among others made of moldable resilient material having an offset between upper and lower jaw, a bite plane which is tapered with the bite plane formed by wings which have varying thickness to create the taper in which the wing members have substantially vertical surfaces on either side thereof for contacting the lateral surfaces of the user's cuspids and bicuspids and in which the main body portion has upper and lower apron and eminence skirts for avoiding contact with the user's frenum and cuspid eminences and in which the internal wing members have a range in size, at the cuspid, from about 6 to about 12 mm in width, from about 14 to about 40 mm in length and from about 2 mm to about 8 mm in thickness. The greater the offset, the shorter the length of the internal wing members.

13 Claims, 4 Drawing Sheets

CONTOURED ANATOMICAL MOUTHPIECE

This application is a continuation-in-part of application Ser. No. 07/449,560 filed Dec. 12, 1989, now U.S. Pat. No. 5,062,422, which is a continuation-in-part of Ser. No. 07/283,611 filed Dec. 13, 1988, now abandoned, both by the present inventor. Those applications are incorporated by reference into this application as fully as if they were set forth herein.

BACKGROUND OF THE INVENTION

1. Field of the Invention

The present invention relates to mouthpieces which are used in underwater breathing devices such as snorkels and regulators and to mouthpieces which are used in inhalators and gastric tubes for medical treatment.

2. Description of the Prior Art

The closest prior art known to applicant are U.S. Pat. Nos. 4,664,109, 4,466,434 and 4,136,689. Each patent shows a mouthpiece of the general type proposed by the present invention. U.S. Pat. No. 4,664,109 shows a mouthpiece which is symmetrical on its upper and lower surfaces with bite lugs which are of constant thickness and width. U.S. Pat. No. 4,466,109 shows an asymmetrical mouthpiece with an offset between the upper and lower surfaces. Bite lugs are shown which are of constant thickness and width and which are connected to each other by a ledge which forms the offset between the upper and lower surfaces to form a place for the upper front teeth to rest. The ledge thus formed is about 40 mm in width.

The prior art does not provide a device which the jaw structure shown in U.S. Pat. No. 4,466,434 is permitted to be in the normal mating bite position without continuing muscle tension. In particular the ball joint shown in FIG. 1 of U.S. Pat. No. 4,466,434 is not kept in a normal rest position by any of the devices disclosed in the patents described above or by any other art known to applicant. In addition, the prior art does not show an offset mouthpiece which is adaptable for both overbite and underbite conditions. The U.S. Pat. No. 4,466,434 device cannot be used with comfort in an underbite condition because of the ledge formed between the bite lugs. No prior art device is designed to place lateral stresses on the cuspids, the teeth best able to handle lateral stresses.

No non-custom made prior art device shows any of the features taught by the present invention. Even the custom made devices known to applicant do not show the structural features of the present invention. The present invention discloses a structure which in three embodiments can provide a properly fitted comfortable mouthpiece for about 95% of the adult human population at the cost of a manufactured device and which has the fit of a custom device.

SUMMARY

The present invention teaches a device with an offset between upper and lower jaw combined with tapered bite wings and a particular bite plane which can be used by persons who require a mouthpiece such as divers and medical patients which mouthpiece does not distort the normal rest position of the jaw bones and jaw muscles including but not limited to the ball joint assembly in the jaw. The present invention teaches a device which can be used with comfort by persons who have either an overbite or an underbite condition.

The present invention utilizes the gripping surfaces between the lips and the mouth both upper and lower portions of each for providing some retention force for holding the mouthpiece. While the prior art has shown devices which can be gripped by the lips and mouth to some extent, no known prior art device shows any effort to provide a device shaped to adapt to the normal bone, tooth and muscle structure of the human mouth.

The present invention utilizes the lateral gripping strength of the upper and lower cuspids for retaining the mouthpiece comfortably in position.

The present invention teaches the use of a range of three mouthpieces having varying offsets from 3 mm to about 6.5 mm, to about 10 mm. These three ranges have been discovered to comfortably fit about 95% of the population.

The present inventive mouthpiece leads to a virtually fatigue free use for substantially all people. However, persons who use dentures either upper only, lower only or both, find a greatly increased comfort from the present invention as compared to prior art devices because the prior art devices put additional pressure on dentures which pressure is transmitted to the jaw at specific locations causing pain.

The present invention can be used with mouthpieces without tapered bite wings as I disclosed in my earlier patent applications. Such use will not achieve the optimum result which can be achieved by the inventive combination of tapered bite wings with the structure disclosed in the present invention.

The present invention is shown in three embodiments which are described below. Each embodiment is symmetrical about its vertical center line.

DESCRIPTION

In the various figures like parts in the different embodiments are shown by the same tens and ones numbers but differ by having a hundreds number which is either 1, 2, or 3. The various embodiments will be described in detail only as to the significant differences after a complete description of one embodiment of the invention.

Figure 1:
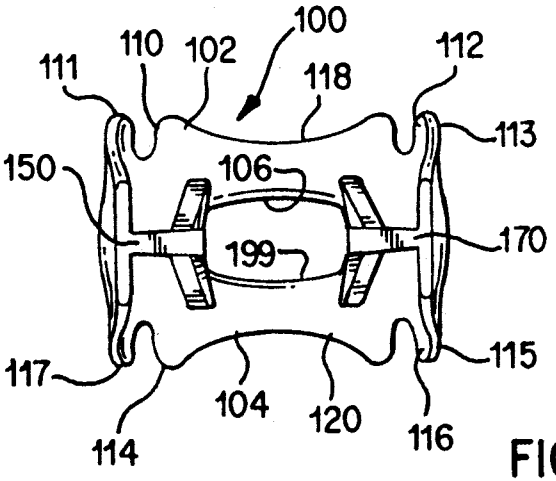
FIG. 1 shows a rear view of one embodiment of the present invention.

FIG. 1 shows a front view of one embodiment 100 of the present invention formed of a moldable resilient material in which a standard coupling 107 having a gas inlet and outlet orifice 106 is formed on one end. A "U" shaped body 109 is formed into two legs 140, 142. Internal wing members 150, 170 are formed in either side of the generally U shaped body 109.

Figure 13:
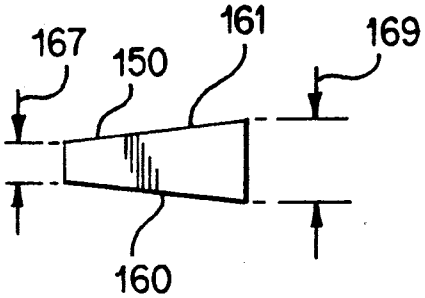
FIG. 13 is a view of a portion a bite wing shown in my earlier applications to show the taper thereof.

The wings, as shown in FIG. 13, have a taper as shown by the different thickness dimensions 167 and 169 which are different by about 2 mm (1–4 mm). The internal wing members range from 6 to 12 mm in width, 14 to 40 mm in length and 2 to 8 mm in thickness and may be formed of a material which will conform to the shape of the user's teeth.

Figure 2:
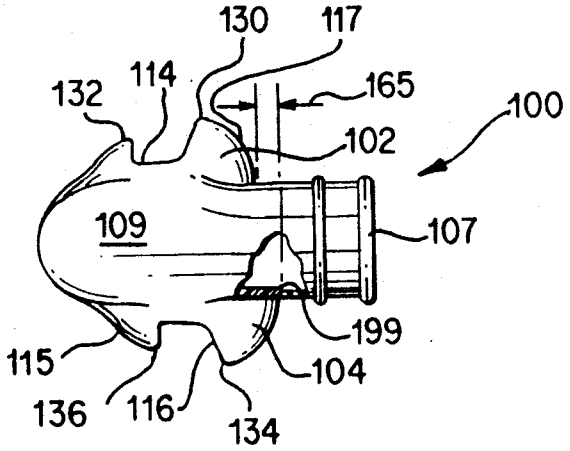
FIG. 2 shows a side view of the embodiment shown in FIG. 1.

FIGS. 1 and 2 shown in detail the structure which enables the users mouth to grip the inventive mouthpiece using the lips, mouth skeletal structure and the upper and lower cuspids and bicuspids. The main body 109, has an upper and lower front apron portion respectively, 102, 104. FIG. 2 shows the mouthpiece in position for use in an "overbite" condition. For the purpose of description only, the present invention is always described with an "overbite" orientation.

Each apron 102, 104, has a lower and upper frenum skirt 118, 120, respectively, for fitting between the lips and bony structure and for avoiding contact with the bony structure of the frenum by having the curved concave structure shown in FIG. 1.

The normal human jaw has an eminence above and below the upper and lower cuspids (eyeteeth) respectively. The eyeteeth themselves are the teeth in the human mouth most able by reason of their deep roots to accept and counter lateral stresses. The present invention takes advantage of those facts of nature by providing the mouthpiece with structure to avoid contact with the cuspid eminences and to maintain contact on the side surfaces of the cuspids themselves.

The structure is shown in FIGS. 1 and 2 as upper and lower eminence skirts 114, 116, which are formed in the upper and lower aprons 102, 104, respectively. The skirts 114, 116, are somewhat uneven "C" shaped surfaces beginning from an upper frenum peak 130, 134 and extending around in a generally "C" shape to a frenum peak 132, 136 respectively.

Figure 3:
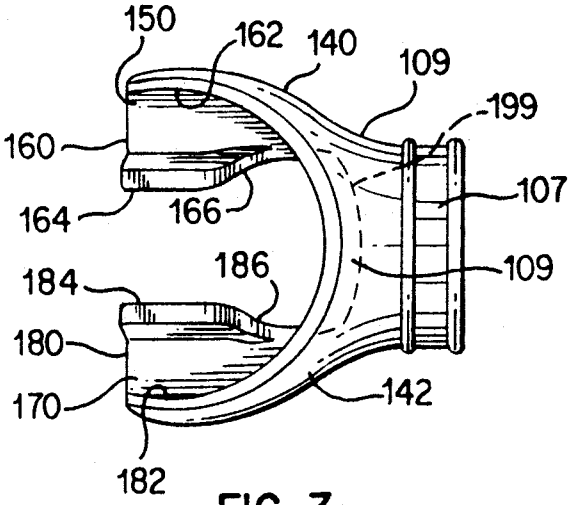
FIG. 3 is a bottom view of the embodiment shown in FIG. 1.
Figure 11:
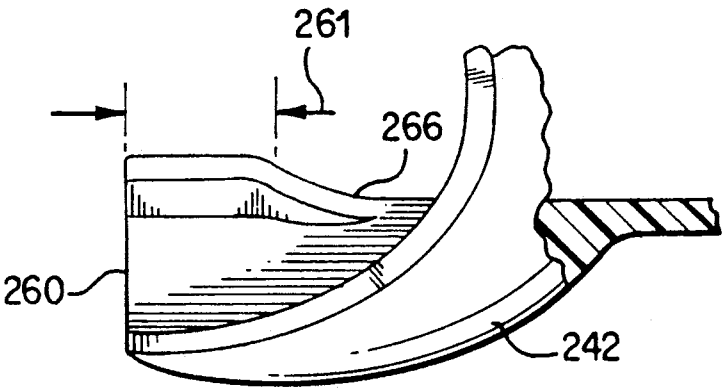
FIGS. 10, 11 and 12 are detailed views of a part of the embodiments shown in FIGS. 3, 6, and 9.
Figure 10:
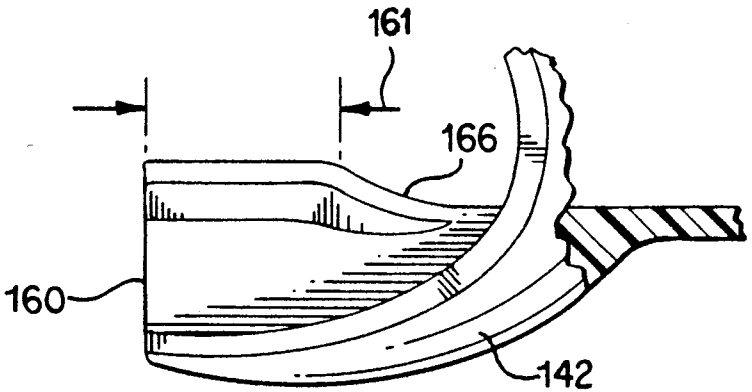
Figure 12:
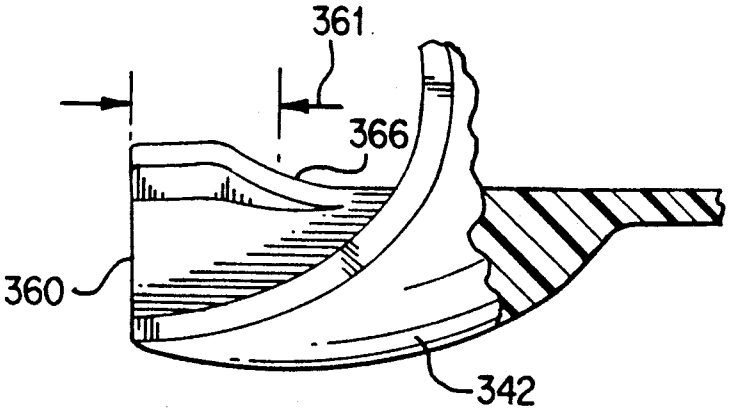

FIG. 3 shows a view of the bite wing members, 150, 170, which receive the bicuspids and cuspids of the lower jaw of a person with an "overbite". Each bite wing has a lower surface 160, 180 for contacting the upwardly extending surfaces of the users' bicuspids and cuspids. Substantially perpendicular to the lower surfaces 160, 180 rise two (vertical) walls 162, 164. and 182, 184 for each bite wing. Surfaces 162, 182 are portions of the apron 104. Surfaces 164, 184 are part of a "vertical" wall formed to contact the inside lateral surfaces of the user's bicuspids. Surfaces 164, 184, terminate in a curved "vertical" wall portion 166, 186 formed to contact the lateral surfaces of the user's cuspids for approximately forty-five degrees of curvature. Surfaces 161, 182 also are curved to contact the lateral surfaces of the cuspids for about forty-five degrees of curvature on the outside lateral surface of the cuspids. This structure is clearly shown in FIGS. 10, 11 and 12 for each embodiment of the present invention.

Figure 5:
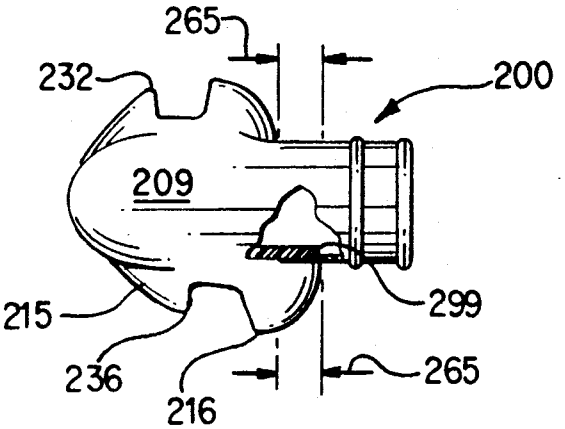
FIGS. 5 and 6 are respectively side and top views of a second embodiment of the present invention.
Figure 6:
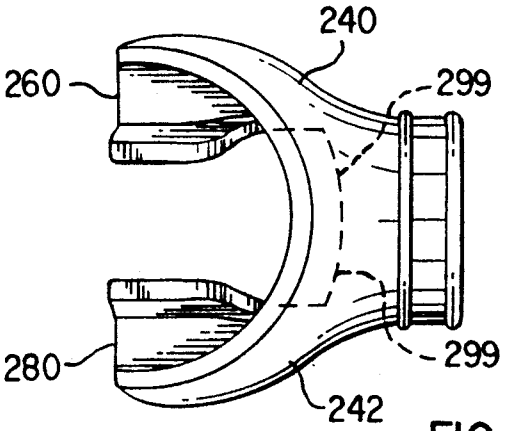
Figure 4:
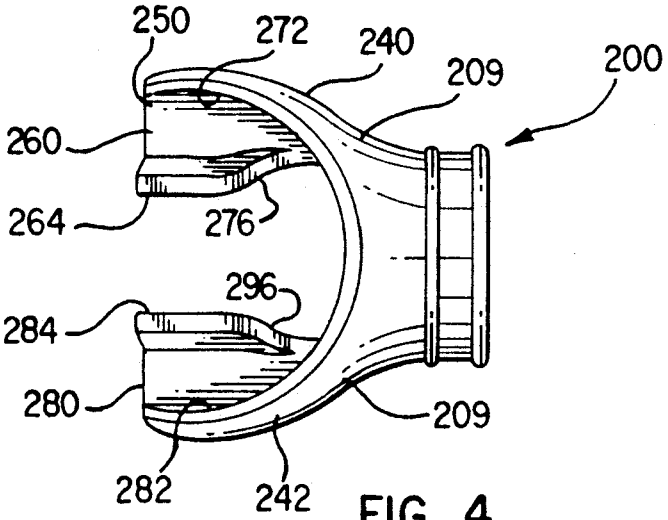
FIG. 4 is top view of any embodiment of the present invention.
Figure 8:
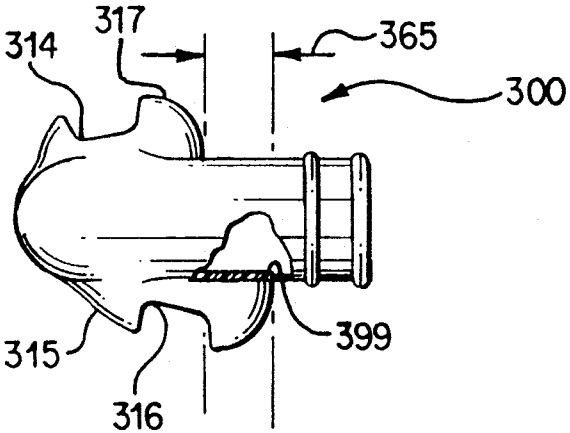
FIGS. 7, 8 and 9 are front, side and bottom views of a third embodiment of the present invention.
Figure 7:
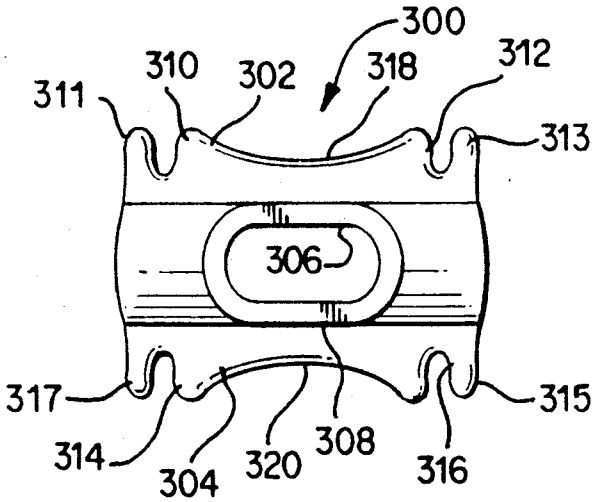
Figure 9:
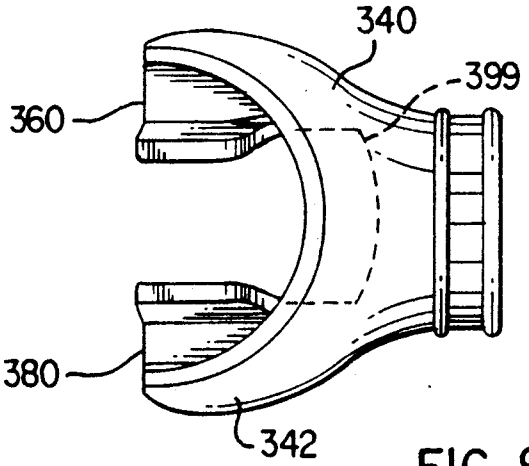

The "offset" ledge, 199, 299, 399 for each embodiment is shown clearly in the pairs of drawings for each embodiment. FIGS. 2 and 3 for the first embodiment. FIGS. 5 and 6 for the second embodiment and FIGS. 8 and 9 for the third embodiment. In each embodiment, as best seen in FIG. 1, the offset ledge reaches in an open "C" shape, disposed in a vertical plain, assuming the user to be standing, to reach below the bite wing lower surface 160, 180, and then to curve upward to contact at one end of the bite wing 160, 180, its lower surface. The width of the ledge 199, 299, 399, ranges from about 3 mm to about 6.5 mm to about 10 mm in the first, second and third embodiments.

The internal wing members have a range in size, at the cuspid, from about 6 to about 12 mm in width, from about 14 to about 40 mm in length and from about 2 mm to about 8 mm in thickness. The greater the offset, the shorter the length of the internal wing members.

Each bite wing lower surface 160, 260, 360, has a length designated, respectively 161, 261, 361. Each embodiment's ledge 199, 299, 399, has a ledge width designated 165, 265, 365. The sum of each ledge width and bite wing lower surface is substantially equal to a constant. Put another way, the length of 161 plus 165 equals the length of 261 plus 265 which equals the length of 361 plus 365.

The present invention has been described with reference to particular embodiments. However those skilled in the art understand that many changes and modifications of those embodiments are possible which are within the scope of the present invention.

I claim:

1. A mouthpiece oriented for an overbite comprising:

U shaped body member having first and second ends and upper and lower portions;

the first end formed in a generally oval shape and having an orifice formed therein;

the second end extending away from the orifice and formed into two leg members, each having an outer end;

a internal wing member formed on each leg member near the outer end thereof;

the lower portion of the U shaped member extending outwardly toward the leg members more than the upper portion of the U shaped member to form an offset which reaches to the lower level of the internal wing members;

the internal wing members having first and second ends;

said wing members have a taper such that the first end farther from the orifice is smaller than the second end nearer the orifice;

said wing members having a laterally extending surface bounded on either side thereof by substantially vertical curved walls for contacting the lateral surfaces of the user's cuspids and bicuspids.

2. The mouthpiece claimed in claim 1 including wherein said U shaped body member has upper and lower front apron segments in which each of said aprons has a generally concave curved surface for fitting between the lips and gums of the user without contacting the user's frenum.

3. The mouthpiece claimed in claim 2 wherein the upper and lower aprons each have first and second ends;

adjacent the first and second end of each upper and lower apron is formed a "C" shaped surface adapted to avoid contact with the user's upper and lower and right and left cuspid eminences.

4. The mouthpiece claimed in claim 2 wherein the internal wing members have a range in size from, at the cuspid, about 6 to about 12 mm in width, from about 14 to about 40 mm in length and from about 2 to about 8 mm in thickness.

5. The mouthpiece claimed in claim 1 wherein the width of the offset ranges from about 3 to about 10 mm.

6. The mouthpiece claimed in claim 5 wherein said bite wing members have a length; and, wherein said offset width and said wing members length when added are substantially equal to a constant.

7. The mouthpiece claimed in claim 1 wherein said wing members vertical walls are curved in a direction to intersect each other to contact lateral surfaces of the user's upper and lower cuspids.

8. A mouthpiece (oriented for an overbite) comprising:

U shaped body member having first and second ends and upper and lower portions;

the first end formed in a generally oval shape and having an orifice formed therein;

the second end extending away from the orifice and formed into two leg members, each having an outer end;

a internal wing member formed on each leg member near the outer end thereof;

the internal wing members having first and second ends;

said wing members have a taper such that the first end farther from the orifice is smaller than the second end nearer the orifice;

said wing members having a laterally extending surface bounded on either side thereof by substantially vertical curved walls for contacting the lateral surfaces of the user's cuspids and bicuspids.

9. The mouthpiece claimed in claim 8 wherein said wing members vertical walls are curved in a direction to intersect each other to contact lateral surfaces of the user's upper and lower cuspids.

10. The mouthpiece claimed in claim 9 including wherein said U shaped body member has upper and lower front apron segments in which each of said aprons has a generally concave curved surface for fitting between the lips and gums of the user without contacting the user's frenum.

11. The mouthpiece claimed in claim 10 wherein the upper and lower aprons each have first and second ends;

adjacent the first and second end of each upper and lower apron is formed a "C" shaped surface adapted to avoid contact with the user's upper and lower and right and left cuspid eminences.

12. The mouthpiece claimed in claim 8 wherein said internal wing members have upper and lower surfaces which have different lateral extent.

13. The mouthpiece claimed in claim 12 wherein the said difference in lateral extent is approximately equal to the width of the offset.

* * * * *